United States Patent [19]

Knoblauch et al.

[11] 4,088,590

[45] May 9, 1978

[54] HYDRAULIC FLUID CONTAINING TERTIARY BUTYL ETHERS

[75] Inventors: Wolfgang Knoblauch, Burghausen, Salzach; Rainer Mücke, Burgkirchen, Alz; René Salvador, Altotting, all of Germany

[73] Assignees: Hoechst Aktiengesellschaft; Alfred Teves GmbH, both of Frankfurt am Main, Germany

[21] Appl. No.: 727,460

[22] Filed: Sep. 28, 1976

Related U.S. Application Data

[63] Continuation of Ser. No. 512,166, Oct. 4, 1974, abandoned.

[30] Foreign Application Priority Data

Oct. 9, 1973 Germany ..... 2350569

[51] Int. Cl.[2] ..... C10M 3/22; C10M 3/14

[52] U.S. Cl. ..... 252/73

[58] Field of Search ..... 252/73, 52 A; 260/615 B

[56] References Cited

U.S. PATENT DOCUMENTS

| | | | |
|---|---|---|---|
| 2,520,611 | 8/1950 | Roberts et al. | 252/73 X |
| 2,520,612 | 8/1950 | Roberts et al. | 252/73 X |
| 2,687,377 | 8/1954 | Stewart et al. | 252/77 X |
| 2,801,968 | 8/1957 | Forby et al. | 252/32.5 |
| 2,839,468 | 6/1958 | Stewart et al. | 252/32.5 |
| 3,629,111 | 12/1971 | Cramer | 252/75 |
| 3,779,930 | 12/1973 | Alcorn et al. | 252/77 |

FOREIGN PATENT DOCUMENTS

| | | | |
|---|---|---|---|
| 687,307 | 5/1964 | Canada | 260/615 B |
| 850,990 | 10/1960 | United Kingdom | 252/73 |

*Primary Examiner*—Harris A. Pitlick
*Attorney, Agent, or Firm*—Connolly and Hutz

[57] ABSTRACT

Brake fluids and operating fluids for central hydraulic installations in motor vehicles having an excellent temperature / viscosity behavior and good lubricating properties are obtained by the admixture to conventional polyethylene glycol alkyl ether-based fluids of alkyl polyethylene glycol-t-butyl ethers of the formula

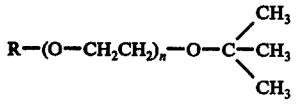

in which R is a straight or branched chain alkyl radical having from 1 to 4 carbon atoms and *n* is an integer of from 2 to 10, preferably from 2 to 5. Mixture of the ethers may be employed.

3 Claims, No Drawings

HYDRAULIC FLUID CONTAINING TERTIARY BUTYL ETHERS

This application is a continuation of application Ser. No. 512,166 filed Oct. 4, 1974 now abandoned.

The present invention relates to a hydraulic fluid containing from 5 to 30% by weight of an alkyl polyethylene glycol tert. butyl ether of the formula

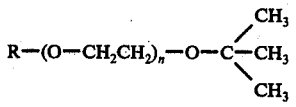

in which R represents a linear or branched alkyl radical having from 1 to 4 carbon atoms and *n* is a whole number in the range of from 2 to 10, preferably 2 to 5, or of a mixture of such ethers.

With the development of disk brakes, more powerful engines and heavier vehicles brake fluids with increasing thermal stability are required. The use of high boiling components is necessary to avoid a breakdown by the formation of vapor bubbles.

By increasing the chain length of the hitherto used polyethylene glykol monoalkyl ethers with propylene oxide or propylene oxide/ethylene oxide mixtures liquids having the required high boiling point can be obtained (cf. German Pat. No. 1,275,242; German Offenlegungsschrift No. 1,644,895). Simultaneously, the alkyl polyalkylene glycol ethers obtained necessarily become more and more viscous. With increasing viscosity of the modified polyglycol ethers, however, the proportion of the viscous lubricant (for example, the polyalkylene glycols) in the hydraulic fluid has to be reduced when the limits laid down in the known specifications (for example of SAE and the Department of Transportation) should be maintained, whereby the lubrifying properties of the fluids are diminished.

In hydraulic systems for motor vehicles auxiliary aggregates operated with piston pumps or vane pumps are used to an increasing extent (for example, steering and coupling aids, antiblocking devices, level regulators). Consequently, higher demands are made on the lubrifying properties of the hydraulic fluid which can only be satisfied with a sufficient proportion of lubricant.

Attempts have repeatedly been made to improve the temperature-viscosity properties by adding so-called "VI improvers," for example, carboxylic acid esters (cf. British Pat. No. 1,083,324; German Pat. No. 1,644,882) and high molecular weight polymers of acrylic or methacrylic acid (cf. German Pat. Nos. 1,107,869, 1,594,387; German Offenlegungsschrift No. 1,644,872). All compounds hitherto used are of high molecular weight and hence, they are more viscous and can be added in very limited quantities only. Moreover, they are very sensitive to shearing, little compatible with water and tend to saponify or to form flakes or turbidities in the brake fluid.

It has now been found that the demands made on heavy duty brake fluids can be fully satisfied by using the alkyl polyethylene glycol tert. butyl esters specified above without the other properties such as compatibility with water, antifreezing quality, good temperature-viscosity behavior, miscibility with other liquids and good compatibility with rubber, plastic materials and various metals being detrimentally affected. Thus, the hydraulic fluid in accordance with the invention combines the maximum properties to be expected of an efficient brake fluid.

The alkyl polyethylene glycol tert. butyl ethers used for the production of the hydraulic fluid of the invention are prepared in analogy to the method described in German Pat. No. 868,147 according to which a hydroxyl group containing compound is reacted with isobutylene in the presence of an acid catalyst and the reaction product obtained is purified, for example, by distillation.

Suitable starting products for making the substances to be used according to the invention are mono-ethers of the corresponding polyethylene glycols. Mixtures of such ethers as obtained in the reaction of ethylene oxide with the corresponding alcohols can also be used. In the latter case mixtures of ethers are obtained the individual components of which only differ by the number of ethylene oxide units in the molecule, which mixtures can also be used for the intended purpose.

As viscosity regulating components in the sense of the present invention the following compounds, cited by way of example, can be used: methyltriethylene glycol tert. butyl ether, methyltetraethylene glycol tert. butyl ether, methyl-pentaethylene glycol tert. butyl ether, ethyldiethylene glycol tert. butyl ether, ethyltriethylene glycol tert. butyl ether, n-propyl-diethylene glycol tert. butyl ether, n-propyltriethylene glycol tert. butyl ether, n-propyl-tetraethylene glycol tert. butyl ether, isopropyldiethylene glycol tert. butyl ether, n-butyldiethylene glycol tert. butyl ether, n-butyltriethylene glycol tert. butyl ether, isobutyldiethylene glycol tert. butyl ether, isobutyltriethylene glycol tert. butyl ether. The properties of the aforesaid compounds are summarized in the following Table I.

The compounds are used either individually or in the form of mixtures in an amount of from 5 to 30% by weight, calculated on the finished brake fluid.

The alkyl polyethylene glycol tert. butyl ethers are preferably used as solvents and viscosity regulators in hydraulic fluids for motor vehicle hydraulics. They are characterized by high boiling points, good antifreeze stability, low viscosities and reduced hygroscopy with respect to the corresponding mono-ethers of the polyalkylene glycols.

The following examples illustrate the invention.

EXAMPLE OF PREPARATION

Methyl-diethylene glycol tert. butyl ether

An autoclave with stirrer was charged with 4,800 parts by weight of methyl-diglycol and 480 parts by weight of an acid ion exchanger resin in the $H^+$ form, the autoclave was evacuated and 2,800 parts of isobutylene were introduced while stirring at 35° to 40° C over a period of about 15 to 30 minutes. The pressure was adjusted to 6 atmospheres gauge with nitrogen and then the mixture was stirred for 4 to 8 hours. After filtration of the catalyst, 7,350 parts by weight of a product were obtained having the following composition:

5.3% of isobutylene and its oligomers
90.4% of methyldiethylene glycol tert. butyl ether
4.2% of methyl-diglycol.

By distillation under a pressure of 12 torrs the methyldiethylene glycol tert. butyl ether was obtained at 67° to 69° C in a purity of 98.9%, the balance being 1.1% of methyl-diglycol.

In the same manner other alkyl polyethylene glycol tert. butyl ethers were prepared either in pure form or in the form of mixtures which possibly contained portions of components having more than 5 ethylene oxide units in the molecule. Owing to the fact that alkyl polyethylene glycol tert. butyl ethers of the above formula in which n is greater than 5 cannot be distilled without decomposition, the etherification reaction was interrupted at a hydroxyl number of 6 to 10, the catalyst eliminated by filtration and the low boiling constituents removed by distillation, for example, in a thin layer evaporator. Some of the compounds obtained and the properties thereof are listed in the following Table I.

TABLE I

| | boiling point 760 mm Hg ° C | Viscosity (cSt) −40° C | 37.8° C | 98.9° C | setting point ° C |
|---|---|---|---|---|---|
| methyltriethylene glycol tert.butyl ether | 246 | 61 | 2.5 | 1.0 | −75 |
| methltetraethylene glycol tert.butyl ether | 291 | 134 | 3.6 | 1.3 | −70 |
| methylpentaethylene glycol tert.butyl ether | 324 | — | 5.3 | 1.8 | −16 |
| ethyldiethylene glycol tert.butyl ether | 202 | 22 | 1.6 | 0.8 | −75 |
| ethyltriethylene glycol tert.butyl ether | 254 | 64 | 2.6 | 1.1 | −60 |
| n-propyldiethylene glycol tert.butyl ether | 218 | 24 | 1.7 | 0.9 | −75 |
| n-propyltriethylene glycol tert.butyl ether | 265 | 74 | 2.9 | 1.1 | −68 |
| n-propyltetraethylene glycol tert.butyl ether | 302 | 143 | 4.0 | 1.6 | −57 |
| isopropyldiethylene glycol tert.butyl ether | 215 | 20 | 1.5 | — | −75 |
| n-butyldiethylene glycol tert.butyl ether | 236 | 57 | 2.1 | 1.0 | −75 |
| n-butyl-triethylene glycol tert.butyl ether | 290 | 109 | 3.3 | 1.3 | −68 |
| isobutyldiethylene glycol tert.butyl ether | 227 | 35 | 1.9 | 1.0 | −75 |
| isobutyltriethylene glycol tert.butyl ether | 276 | 104 | 3.2 | 1.3 | −75 |

EXAMPLES OF APPLICATION

Group A

Central Hydraulic Fluids for Motor Vehicles According to SAE Standard 71 R 2

In motor vehicle operation highest demands are made on this group of fluids because additionally to its function in the brake it must have especially good lubricating properties in the operation of vane pumps used to operate steering aids, level regulators, coupling aids or pressure reservoirs. Consequently, it is necessary that a fluid having a higher viscosity is not only efficient as brake fluid but also has good lubricating properties of heavy duty mineral oils. All these properties can be optimized by the addition of the ethers of the above formula.

EXAMPLE 1

A hydraulic fluid was prepared from

50% of triethylene glycol monomethyl ether
27% of methyltetraethylene glycol tert. butyl ether
22% of lubricant on the basis of polyethylene-polypropylene glycol (molecular weight about 4,000)
1% of inhibitors (suitable inhibitors are amines, aminooxalkylates and their salts, boric acid esters, aromatic nitrogen compounds and phosphorus compounds known as corrosion inhibitors and anti-oxidants).

The hydraulic fluid had a boiling point of 260° C, a viscosity of 1,750 cSt. at −40° C and of 5.2 cSt. at 99° C.

EXAMPLE 2

A hydraulic fluid was prepared from

48% of triethylene glycol monomethyl ether
15% of ethyltriethylene glycol tert. butyl ether
26% of lubricant on the basis of polyethylene-polypropylene glycol (molecular weight about 4,000)
1% of inhibitors The hydraulic fluid had a boiling point of 252° C and a viscosity of 1,530 cSt. at −40° C and of 5.1 cSt. at 99° C.

EXAMPLE 3

A hydraulic fluid was prepared from

50% of triethylene glycol monomethyl ether
26% of n-butyltriethylene glycol tert. butyl ether
23% of lubricant on the basis of polyethylene-polypropylene glycol (molecular weight about 4,000)
1% of inhibitors.

The hydraulic fluid had a boiling point of 260° C and a viscosity of 1,730 cSt. at −40° C and of 5.3 cSt. at 99° C.

EXAMPLE 4

A hydraulic fluid was prepared from

47% of triethylene glycol monomethyl ether
17% of n-propyltriethylene glycol tert. butyl ether
25% of lubricant on the basis of polyethylene-polypropylene glycol (molecular weight about 4,000)
1% of inhibitors The hydraulic fluid had a boiling point of 254° C, a viscosity of 1,580 cSt. at −40° C and a viscosity of 5.1 cSt. at 99° C.

A comparative fluid without the addition in accordance with the invention consisted of 79% of triethylene glycol monomethyl ether
20% of lubricant on the basis of polyethylene-polypropylene glycol (molecular weight about 4,000)
1% of inhibitors The fluid had a boiling point of 250° C and a viscosity of 2,040 cSt. at −40° C and of 5.1 cSt. at 99° C.

The hydraulic fluids according to Examples 1 and 2 and the comparative fluid were tested according to the prescriptions of SAE 71 R 2 and the requirements of pump manufacturers. The results are indicated in Table II.

Group B

High Boiling Brake Fluids According to SAE J 1703 c

This group of brake fluids having a boiling point above 290° C has been developed for operation at very high temperatures. By using the compounds in accordance with the invention the proportion of lubricant in the hydraulic fluid can be increased, while the temperature-viscosity properties are improved, to ensure satisfactory lubrification and strongly reduced wear of the vane pump.

EXAMPLE 5

A hydraulic fluid was prepared from

15% of methyltetraethylene glycol tert. butyl ether
56.5% of methyl-(oxethyl-1,2-oxypropyl)-glycol ether
13% of butyl-tri- and -tetra-ethylene glycol mixture
12% of polyethylene glycol 200
2.3% of alkali metal diethylene glycol borate ester mixture
1.2% of inhibitors The hydraulic fluid had a boiling point of 298° C and a viscosity of 1,260 cSt. at −40° C and 2.1 cSt. at 99° C.

EXAMPLE 6

A hydraulic fluid was prepared from 8.0% of n-propyltetraethylene glycol tert. butyl ether
60.5% of methyl-(oxethyl-1,2-oxypropyl)-glycol ether
17.0% of butyl-tri- and -tetraethylene glycol mixture
11.0% of polyethylene glycol 200
2.3% of alkali metal diethylene glycol borate ester mixture
1.2% of inhibitors The hydraulic fluid had a boiling point of 300° C and a viscosity of 1,306 cSt. at −40° C and of 2.15 cSt. at 99° C.

EXAMPLE 7

A hydraulic fluid was prepared from 17.0% of n-butyltriethylene glycol tert. butyl ether
55.5% of methyl-(oxethyl-1,2-oxypropyl)-glycol ether
12.0% of butyl-tri- and -tetraethylene glycol mixture
2.3% of alkali metal diethylene glycol borate ester mixture
1.2% of inhibitors The hydraulic fluid had a boiling point of 295° C and a viscosity of 1,194 cSt. at −40° C and of 2.1 cSt. at 99° C.

The fluid of Example 5 and a comparative fluid without the addition according to the invention were tested according to the prescription of SAE J 1703 c and subjected to a Vickers pump wear test. The results are listed in Table III.

Group C

The Federal Motor Vehicle Safety Standard No. 116 of the American National Highway Traffic Safety Administration prescribes that a high boiling brake fluid (boiling point at least 230° C) of the type DOT 4 should have a so-called wet boiling point of at least 155° C in the presence of water.

This requirement can be complied with, for example, by adding boric acid esters of diethylene glycol. With the use of the tert. butyl ethers of the invention these highly viscous boric acid compounds can be added to the hydraulic fluid without a viscosity of at most 1,800 cSt. at −40° C being exceeded.

EXAMPLE 8

A hydraulic fluid was prepared from

20% of methyltetraethylene glycol tert. butyl ether
53% of methyl-(oxethyl-1,2-oxypropyl)-glycol ether
14% of butyl-tri- and tetra-ethylene glycol mixture
12% of alkali metal diethylene glycol borate esters
1% of inhibitors The hydraulic fluid had a boiling point of 296° C, a wet boiling point of 170° C and a viscosity of 1,695 cSt. at −40° C and 2.6 cSt. at 100° C.

EXAMPLE 9

A hydraulic fluid was prepared from

15% of n-propyltetraethylene glycol tert. butyl ether
60% of methyl-(oxethyl-1,2-oxypropyl)-glycol ether
14% of butyl-tri- and -tetra-ethylene glycol mixture
10% of alkali metal diethylene glycol borate esters
1% of inhibitors The hydraulic fluid had a boiling point of 292° C, a wet boiling point of 168° C and a viscosity of 1,670 cSt. at −40° C and of 2.6 cSt. at 100° C.

Table II

| Group A<br>Central hydraulic fluid for motor vehicles according to S A E 71 R | Example 1 | Example 2 | comparative Example | prescribed value SAE 71 R 2 and SAE J 1703 c |
|---|---|---|---|---|
| monomethyl ether of triglycol | 50 % | 48 % | 79 % | |
| methyltetraethylene glycol tert.butyl ether | 27 % | — | — | |
| ethyltriglycol tert.butyl ether | — | 15 % | — | |
| lubricant (mean MG 4,000) | 22 % | 26 % | 20 % | |
| inhibitors | 1 % | 1 % | 1 % | |
| viscosity −40° C | 1750 cSt | 1530 cSt | 2040 cSt | at most 1800 cSt |
| 37.8 ° C | 18.2 cSt | 16.9 cSt | 19.1 cSt | — |
| 98.9 ° C | 5.2 cSt | 5.1 cSt | 5.1 cSt | at least 4.5 cSt |
| boiling point | 260° C | 252° C | 250° C | at least 204° C |
| flash point | 130° C | 126° C | 125° C | at least 97° C |
| cold test A $6^h$/−40° C | fulfilled | fulfilled | fulfilled | clear, fluid |
| cold test B $6^h$/−50° C | fulfilled 5" | fulfilled 4" | fulfilled 9" | at most 35 sec. |
| rubber swelling GR-S bottom diameter | + 1.2 mm | + 0.8 mm | + 0.6 mm | at most +1.4 mm |
| $70^h$/120° C decrease in hardness | −10 | −9 | −9 | at most −15 |
| evaporation / solidification point | 77 %/−° C | 72 %/−27° C | 77 %/−30° C | at most 80 %/−5° C |
| water tolerance −40/+60° C | fulfilled | fulfilled | fulfilled | no layer formation, |

Table II-continued

| Group A<br>Central hydraulic fluid for motor vehicles according to S A E 71 R | Example 1 | Example 2 | comparative Example | prescribed value SAE 71 R 2 and SAE J 1703 c |
|---|---|---|---|---|
| | | | | no deposit |
| wear tests | | | | |
| a) in vane pump, speed range 1,000-3,000 rev/min, delivery 5 ml/rev, 3,000 rev/min/15$^h$/ 150 bar | | | | |
| blade wear | — | 0 mg | −4.3 mg | requirement of |
| highest wear | — | >200 bar | at 160 bar | motor vehicle manufacturers |
| | | | | no wear |
| viscosity after test at 98.9° C | — | 5.1 cSt | 5.0 cSt | at least 4.5 cSt |
| b) Vickers pump test on vane pump V 104 C, 250 h/1,400 rev/min/140 bar | | | | |
| blade wear | 3 mg | 0 mg | 50 mg | <50 mg |
| plate wear | 5 mg | 0 mg | 110 mg | <200 mg for heavy duty oils |
| c) stroking test according to SAE J 1703 c | | | | |
| 85,000 strokes 120° C/70 kg/ cm$^2$ | fulfilled | fulfilled | fulfilled | no corrosion fluid loss at most 36 ml no deposit and abraded material in fluid |
| oxydation stability | | | | |
| according to SAE 1703 c A1 | ±0 mg/cm$^2$ | ±0 mg/cm$^2$ | −0.01 mg/cm$^2$ | at most −0.05 mg/cm$^2$ |
| cast iron | −0.06 | −0.04 | −0.03 | at most −0.3 |
| corrosion | | | | |
| 120$^h$/100° C Sn | 0 | −0.01 | 0 | ±0.2 mg/cm$^2$ |
| steel | 0 | 0 | +0.01 | ±0.2 |
| A1 | 0 | 0 | −0.01 | ±0.1 |
| loss in weight in mg/cm$^2$ *cast iron* | 0 | 0 | 0 | ±0.2 |
| brass | −0.01 | −0.01 | −0.02 | ±0.4 |
| copper | −0.02 | −0.03 | −0.03 | ±0.4 |

Table III

| Group B<br>High boiling brake fluid according to SAE J 1703 c | Example 5 % | comparative Example % |
|---|---|---|
| methyltetraethylene glycol tert.butyl ether | 15.0 | — |
| methyl-(oxyethyl-1,2-oxypropyl)-glycol ether | 56.5 | 60.5 |
| methyltetraglycol (techn. grade) | — | 15.0 |
| bubyltri/tetraglycol mixture | 13.0 | 13.0 |
| polyethylene glycol 200 | 12.0 | 9.0 |
| alkeli metal diethylene glycol borate esters | 2.3 | 1.3 |
| inhibiters | 1.2 | 1.2 |
| viscosity −40° C | 1260 cST | 1480 cSt |
| 20°C | 15.2 cST | 15.5 cST |
| 100° C | 2.1 cST | 2.1 cSt |
| finish point | 155° C | 140° C |
| boiling point | 298° C | 297° C |
| boiling point stability | −2.0° C | −2.5° C |
| setting point | −74° C | −72° C |
| cold test A | fulfilled | fulfilled |
| cold test B | air bubble 3" | fulfilled |
| water tolerance −40° C | fulfilled | fulfilled |
| −60° C | fulfilled | fulfilled |
| evaporation | 29 % | 30 % |
| evaporation residue /setting point | −64° C | −60° C |
| rubber swelling SBR 70$^h$ (120° C) ϕ | +1.0 mm | +0.8 mm |
| Shore hardness | −11 | −12 |
| wet boiling point | 151° C | 147° C |
| according to DOT test $H_20$ content | 2.8 % | 3.6 % |
| wear tests | | |
| n) in vane pump (speed range 1,000-3,000 rev/min) .500 rev/min/15 h/ 150 bar delivery b ml/rev | | |
| blade wear | 1.2 mg | 8.7 mg |
| maximum wear | 480 bar | 100 bar |
| b) VKA seizing load | 180/200 kg | 120/140 kg |
| c) simulated service behavior in brakes 85,000 strokes at 120° C/70 kg | | |
| change of diameter of cylinder and piston | none | −0.08 mm |
| recognizable corrosion | none | none |
| change of diameter of rubber sleeves | 18 % | 16 % |
| drop in hardness of rubber sleeves | −9 | −9 |
| fluid loss | 3 ml | 11 ml |
| abraded matter and deposits on metal parts | none | traces |
| abraded matter, deposits or gelation of fluid | without | without |
| corrosion at 100° C/120$^h$ | | |

Table III-continued

| Group B High boiling brake fluid according to SAE J 1703 c | Example 5 % | comparative Example % |
|---|---|---|
| less in weight mg/cm² Sn | 0 | −0.02 |
| steel | 0 | 0 |
| Al | c | −0.03 |
| cast iron | 0 | 0 |
| brass | −0.014 | −0.020 |
| copper | −0.108 | −0.210. |
| oxidation stability according to SAE J 1703 c | no corrosion no deposit | no localized corrosion. no deposit |
| less in weight mg/cm² Al/cast iron | +0/−0.03 | −0.02/−0.08 |

Table IV

| Group C according to FMVSS - No. 116 - type D O T 4 (Federal Motor Vehicle Safety Standard) | Example C | Example 9 | comparative Example |
|---|---|---|---|
| | % | % | % |
| methyltetraglycol tert.butyl ether | 20.0 | — | — |
| propyltetraglycol tert.butyl ether | — | 15.0 | — |
| methyl-(oxyethyl-1,2-oxypropyl)-glycol ether mixture | 53.0 | 60.0 | 75.0 |
| butyltri-tetraethylene glycol mixture | 14.0 | 14.0 | 14.0 |
| alkali metal diethylene glycol borate ester mixture | 12.0 | 10.0 | 10.0 |
| inhibitors | 1.0 | 1.0 | 1.0 |
| vincosity at −40° C | 1695 | 1670 | 2100 |
| in est. 20° C | 10.3 | 18.2 | 20.1 |
| 100° C | 2.6 | 2.6 | 2.6 |
| flash point | 150° C | 155° C | 149° C |
| boiling point (ASTM) | 290° C | 292° C | 280° C |
| boiling point stability | −2° C | −2° C | −3° C |
| wet boiling point (DOT test) | 170° C | 168° C | 164° C |
| $H_2O$ content | 2.6 % | 2.9 % | 3.4 % |
| evaporation / setting point | 56 % (−62° C) | 58 % (−57° C) | 53 % (−50° C) |
| cold test A | fulfilled | fulfilled | fulfilled |
| cold test B | sulfilled | fulfilled | fulfilled |
| water tolerance −40° C | fulfilled | fulfilled | fulfilled |
| +60° C | fulfilled | fulfilled | fulfilled |
| rubber swelling SBR | | | |
| $70^5$/120° C ϕ | +0.9 mm | +0.8 mm | +0.7 mm |
| hardness | −11 | −10 | −8 |
| pH-SAE | 8.0 | 7.9 | 7.5 |
| corrosion $120^h$/100° C Sn | 0 | — | −0.13 |
| steel | 0 | — | −0.05 |
| change in weight mg/cm² Al | 0 | — | −0.02 |
| cast iron | 0 | — | −0.01 |
| brass | −0.06 | — | −0.08 |
| copper | −0.9 | — | −0.12 |
| VKA seizing load kg | 180/200 | | 120/140 |
| simulated service behavior 85,000 strokes at 120° C/70 kg | fulfilled | fulfilled | fulfilled |
| thermostability after $1^h$/250° C | no gas escape | no gas escape | no gas excape |

What is claimed is:

1. An improved hydraulic fluid composition consisting essentially of (a) an effective amount for lubrication of polyalkylene glycols, (b) an effective amount for viscosity control of alkyl polyalkylene glycols, (c) an effective amount for corrosion inhibition and antioxidation of inhibitors, and (d) a regulating agent for the viscosity and lubricating properties, wherein the improvement resides in employing as regulating agent 5–30% by weight of the total hydraulic fluid composition of an alkyl polyethylene glycol tert.-butyl ether or a mixture thereof of the formula

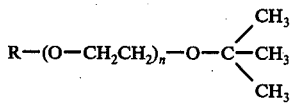

wherein R is a linear or branched alkyl of 1–4 carbons and $n$ is a whole number of 2–10.

2. The improved hydraulic fluid of claim 1, wherein $n$ is 2–5.

3. The improved hydraulic fluid of claim 1, wherein:

(a) the polyalkylene glycol is a polyethylene-polypropylene glycol having a molecular weight of about 4,000 or a polyethylene glycol having a molecular weight of 200, (b) the alkyl polyalkylene glycol is selected from the group consisting of triethylene glycol monomethyl ether, methyl(oxethyl-1,2-oxpropyl)-glycol ether and butyl-tri-and-tetraethylene glycol ether mixture, and (c) the inhibitor is selected from the group consisting of amines, amino-oxalkylates and their salts and boric acid esters.

* * * * *